US006740837B2

(12) United States Patent
Zehnder et al.

(10) Patent No.: US 6,740,837 B2
(45) Date of Patent: May 25, 2004

(54) CONTACT ZONE FOR A POWER BREAKER

(75) Inventors: Lukas Zehnder, Dättwil (CH); Michael Mendik, Samstagern (CH)

(73) Assignee: ABB Schweiz AG, Baden (CH)

( * ) Notice: Subject to any disclaimer, the term of this patent is extended or adjusted under 35 U.S.C. 154(b) by 32 days.

(21) Appl. No.: 09/986,878

(22) Filed: Nov. 13, 2001

(65) Prior Publication Data

US 2002/0060203 A1 May 23, 2002

(30) Foreign Application Priority Data

Nov. 17, 2000 (EP) ..... 00811091

(51) Int. Cl.[7] ..... H01H 33/18

(52) U.S. Cl. ..... 218/43; 218/53; 218/74; 218/62

(58) Field of Search ..... 218/43–48, 51–57, 218/60–64, 74–78, 154–155, 140

(56) References Cited

U.S. PATENT DOCUMENTS 4,843,199 A * 6/1989 Niemeyer ..... 218/14

FOREIGN PATENT DOCUMENTS

DE 3134644 A1 3/1983
DE 3424966 A1 1/1986
DE 19613568 A1 10/1997
EP 0283728 A1 9/1988

* cited by examiner

*Primary Examiner*—Lincoln Donovan
(74) *Attorney, Agent, or Firm*—Burns, Doane, Swecker & Mathis, L.L.P.

(57) ABSTRACT

A contact zone (1) of a quenching chamber which is arranged rotationally symmetrical about a central axis (2) and is filled with an insulating medium, having at least two stationary consumable contacts which are in the form of contact rings (4, 15) and which, when the quenching chamber is closed, are electrically conductively connected by means of a bridging contact which is arranged centrally and can move axially. The mutually facing end surfaces of the consumable contacts are partially covered by electrically insulating covers (11, 22). The aim is to provide insulating covers which are designed to have good dielectric characteristics and are easy to install. This is achieved in that a wedge-shaped annular gap (11*a*, 22*a*) which is open in the radial direction and originates from a contact-making edge (10, 21), of the cover (11, 22) is provided between a contact-making surface (7, 18) and an insulating cover (11, 22) and in that the edge (10, 21) is dielectrically shielded by means of an annular bead (8, 19) which projects beyond the contact-making surface (7, 18).

6 Claims, 1 Drawing Sheet

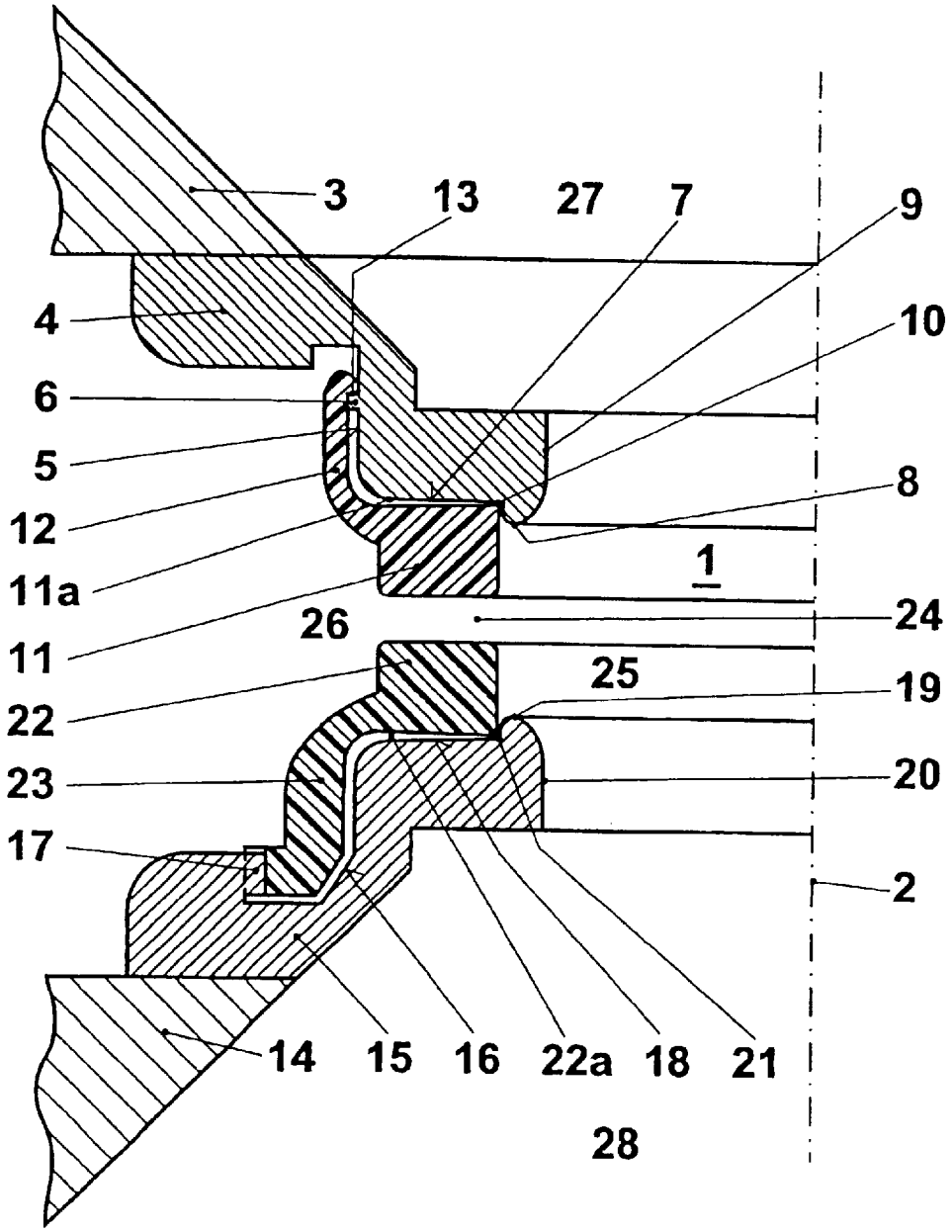
3
13
27
7
9
4
10
6
5
8
12
1
11a
26
24
11
25
22
19
23
20
17
2
14
15
16
22a
18
21
28

CONTACT ZONE FOR A POWER BREAKER

TECHNICAL FIELD

The invention is based on a contact zone for a power breaker, as claimed in the precharacterizing clause of claim 1.

PRIOR ART

Laid-open Specification DE 196 13 568 A1 discloses a power breaker which is filled with an insulating gas and may be used in an electrical high-voltage network. This power breaker has a cylindrical quenching chamber with a contact zone located in its rated current path. Two stationary consumable contacts, are provided in the contact zone, are arranged on a central axis and, when the power breaker is connected, are electrically conductively connected by means of a bridging contact. In this case, the bridging contact is arranged in the interior of the rotationally symmetrical consumable contacts. In order to prevent excessive radial movement of the arc bases, the mutually facing end surfaces of the consumable contacts are at least partially covered with insulation. The fitting of the insulating cover is comparatively complex, since this cover can be distorted under the influence of the temperatures that occur in the arcing zone.

DESCRIPTION OF THE INVENTION

The invention, as it is characterized in the independent claim, achieves the object of providing a contact zone for a power breaker, in which insulating covers for the end surfaces of the consumable contacts are designed with good dielectric characteristics, and are simple to install.

The advantages achieved by the invention are that the covers can always comply with the stringent dielectric requirements in this area, despite deformation caused by heat, in particular even during the disconnection process, and immediately after it.

This invention is based on the contact zone of a quenching chamber which is arranged rotationally symmetrically about a central axis and is filled with an insulating medium, having at least two stationary consumable contacts which are in the form of contact rings and which, when the quenching chamber is closed, are electrically conductively connected by means of a bridging contact which is arranged centrally and can move axially and having electrically insulating covers, which at least partially cover mutually facing end surfaces. Here, for the first time, an annular gap which annular gap is open in the radial direction, originates from a contact-making edge of the cover, is provided between a contact-making surface and an insulating cover, and has a wedge-shaped cross section, with the edge being dielectrically shielded by means of an annular bead which projects beyond the contact-making surface.

One particular advantage is that the edge is always pressed by spring force against the contact-making surface, thus ensuring that no erosion particles can penetrate into the annular gap, where they could have a dielectrically disadvantageous effect.

BRIEF DESCRIPTION OF THE DRAWING

The single FIGURE shows a highly simplified partial section through the contact zone of a power breaker in the disconnected state.

Only those elements which are required for direct understanding of the invention are illustrated and described.

Approaches to Implementation of the Invention

The FIGURE shows a highly simplified partial section through the contact zone 1 of a power breaker in the disconnected state. The contact zone 1 is a part of the rated current path of the power breaker. The power breaker is installed in an enclosure, which is not illustrated but which is filled with an insulating medium. This contact zone 1 is arranged rotationally symmetrically about a central axis 2. An upper metallic holder 3 is fit with an upper contact ring 4, which is manufactured from an erosion-resistant metallic material. A collar 6 is provided on a cylindrical surface 5 facing away from the central axis 2. At right angles to the central axis 2, the upper contact ring 4 has a contact-making surface 7 which merges into the cylindrical surface 5 on the side facing away from this central axis 2, and is rounded to provide good dielectric characteristics. On the side facing the central axis 2, the contact-making surface 7 is bounded by a bead 8 which is fit on it and has good dielectric characteristics. The bead 8 merges on the side facing the central axis 2 into a region of the upper contact ring 4 in the form of a nozzle constriction 9.

An edge 10 of a cover 11 rests on the contact-making surface 7 directly alongside the bead 8, to be precise with this edge 10 being covered by the bead 8 against influences from the direction of the central axis 2, such influences being, in particular, thermal radiation and particles torn off by the flow of the hot gases. The cover 11 is annular and has a rectangular cross section in the region of the covering over the contact-making surface 7. The side of the cover 11 facing the contact-making surface 7 is formed such that only the edge 10 makes contact with it. An annular gap 11*a*, which has a wedge-shaped cross section, remains between the contact-making surface 7 and the side of the cover 11 facing it. A somewhat elastic projection 12 is integrally formed on the outside of the rectangular cross section. The projection 12 forms a rim in the form of a key and extending upward. If the insulating material from which the cover 11 is manufactured is sufficiently elastic, then this projection 12 is not slotted while, if a stiffer material is used, then axially pointing slots are provided in the rim. At the upper end, the projection 12 has an undercut 13, which snaps in behind the collar 6. The cover 11 is pressed against the contact-making surface 7 by the spring force of the projection 12, and is thus held in position. The projection 12 is likewise covered against direct thermal influences from the direction of the central axis 2, so that its spring force is always maintained, despite the high temperatures that occur in its vicinity.

The opposing contact, which is associated with this contact zone 1 and has a virtually identical design, is arranged in mirror-image form with respect to a plane at right angles to the central axis 2. This opposing contact consists of a lower metallic holder 14 which is fit with a lower contact ring 15 which is manufactured from an erosion-resistant metallic material. A groove 16 is incorporated in the contact ring 15, and its flank facing away from the central axis 2 is provided with an internal thread 17. At right angles to the central axis 2, the lower contact ring 15 has a contact-making surface 18, which merges into the other flank of the groove 16 on the side facing away from the central axis 2, rounded to produce good dielectric characteristics. On the side facing the central axis 2, the contact-making surface 18 is bounded by a bead 19 which is fit on it and has good dielectric characteristics. The bead 19 is generally designed to be identical to the bead 8. On the side facing the central axis 2, the bead 19 merges into a region of the lower contact ring 15 in the form of a nozzle constriction 20. The nozzle constriction 20 generally has the same cross section as the nozzle constriction 9.

An edge 21 of a cover 22 rests on the contact-making surface 18 directly alongside the bead 19, to be precise with this edge 21 being covered by the bead 19 against influences from the direction of the central axis 2, such influences being, in particular, thermal radiation and particles torn off by the flow of the hot gases. In a similar way to the cover 11, the cover 22 is annular and has a rectangular cross section in the region of the cover over the contact-making surface 18. The side of the cover 11 facing the contact-making surface 18 is formed such that only the edge 21 makes contact with it. An annular gap 22*a*, which has a wedge-shaped cross section, remains between the contact-making surface 18 and the side of the cover 22 facing it. A somewhat elastic projection 23 is integrally formed on the outside of the rectangular cross section. The projection 23 forms a rim in the form of a bell which extends downward. If the insulating material from which the cover 22 is manufactured is sufficiently elastic, then this projection 23 is not slotted while, if a stiffer material is used, then axially pointing slots are provided in the rim. At the lower end of the projection 23, an external thread is provided on the side facing away from the central axis 2 and is screwed into the internal thread 17 of the contact ring 15. The cover 22 is pressed against the contact-making surface 18 by the spring force of the projection 23, and is thus held in position. The projection 23 is likewise covered against direct thermal influences from the direction of the central axis 2, so that its spring force is always maintained, despite the high temperatures that occur in its vicinity.

Like the cover 22, the cover 11 can be provided with a threaded attachment, and the cover 22 can likewise be held by a snap-action attachment in the same way as the cover 11. The versions of the cover 11 and 22 shown here may also be designed in a physically different way. Here, an annular flow gap 24 is provided between the two covers 11 and 22 and, when an arc is burning, allows the heated gas to flow out of the arcing area 25 into the heating volume 26 when the arc is being blown, so that the pressurized gases stored in the heating volume 26 flow in the opposite direction through the flow gap 24 into the arcing area 25, and from there onward into the exhaust volumes 27 and 28.

It is also possible to produce the two covers 11 and 22 integrally and then to incorporate radial holes in this monolithic entity at the appropriate points instead of the flow gap 24. This entity could then, possibly, be attached to only one of the contact rings 4 or 15, using one of the holders described above.

The edges 10 and 21 represent a set of three points which are very effectively dielectrically shielded by metallic beads 8 and 19. If the material of the covers 11 and 22 were to shrink, for example as a result of thermal overloading, the prestressing of the projections 12 and 23 and the wedge-shaped form of the annular gaps 11*a* and 22*a* between the respective contact-making surfaces 7 and 18 and the covers 11 and 22 would ensure that the covers 11 and 22 nevertheless have one edge making contact with the respective contact-making surfaces 7 and 18. No erosion particles, which would have a negative effect on the dielectric characteristics, can enter the annular gap 11*a* or 22*a*.

List of Symbols

1 Contact zone
2 Central axis
3 Upper holder
4 Upper contact ring
5 Cylindrical surface
6 Collar
7 Contact-making surface
8 Bead
9 Nozzle constriction
10 Edge
11*a* Annular gap
11 Cover
12 Projection
13 Undercut
14 Lower holder
15 Lower contact ring
16 Groove
17 Internal thread
18 Contact-making surface
19 Bead
20 Nozzle constriction
21 Edge
22 Cover
22*a* Annular gap
23 Projection
24 Flow gap
25 Arcing area
26 Heating volume
27, 28 Exhaust volume

What is claimed is:

1. A contact zone of a quenching chamber which is arranged symmetrically about a central axis of the chamber and is filled with an insulating medium, having at least two stationary consumable contacts which are in the form of contact rings and which, when the quenching chamber is closed, are electrically conductively connected by means of a bridging contact which is arranged centrally and can move axially and having electrically insulating covers, which at least partially cover mutually facing end surfaces, wherein a wedge-shaped annular gap, which is open in the radial direction and originates from contact-making edges of the insulating covers, is provided between a contact-making surface and an insulating cover and wherein the edges are dielectrically shielded by means of an annular bead which projects beyond the contact-making surface, said insulating cover having a cross section in a region where it covers the contact-making surface, and an elastic projection is formed as a rim on the outside of said cross section and extends in the axial direction.

2. The contact zone as claimed in claim 1, wherein the edge is arranged in the immediate vicinity of the annular bead.

3. The contact zone as claimed in claim 1, wherein the cross section of the cover in the region where it covers the contact-making surface is rectangular.

4. The contact zone as claimed in claim 3, wherein the rim is provided with means which allow the cover to be connected mechanically to the contact ring, and wherein the mechanical connection is made such that the edge is always pressed in a sprung manner against the contact-making surface.

5. The contact zone as claimed in claim 4, wherein the mechanical connection is designed to be detachable.

6. The contact zone as claimed in claim 5.

* * * * *